US009228277B2

(12) United States Patent
Schneider et al.

(10) Patent No.: US 9,228,277 B2
(45) Date of Patent: Jan. 5, 2016

(54) DRIVE DEVICE FOR A COMPACTION DEVICE ON A SPINNING MACHINE

(75) Inventors: Gabriel Schneider, Winterthur (CH); Ludek Malina, Kloten (CH); Radek Zarecky, Ceska Trebova (CZ); Petr Blazek, Chocen (CZ)

(73) Assignee: Maschinenfabrik Rieter AG, Winterthur (CH)

( * ) Notice: Subject to any disclaimer, the term of this patent is extended or adjusted under 35 U.S.C. 154(b) by 270 days.

(21) Appl. No.: 13/989,618

(22) PCT Filed: Nov. 23, 2011

(86) PCT No.: PCT/CH2011/000279

§ 371 (c)(1), (2), (4) Date: May 24, 2013

(87) PCT Pub. No.: WO2012/068692

PCT Pub. Date: Mar. 31, 2012

(65) Prior Publication Data

US 2013/0239721 A1 Sep. 19, 2013

(30) Foreign Application Priority Data

Nov. 26, 2010 (CH) ..... 1985/10

(51) Int. Cl.
*D01H 5/72* (2006.01)
*D01H 5/22* (2006.01)

(52) U.S. Cl.
CPC . *D01H 5/72* (2013.01); *D01H 5/22* (2013.01); *Y10T 74/19642* (2015.01)

(58) Field of Classification Search
CPC ..... D01H 5/22; D01H 5/72
See application file for complete search history.

(56) References Cited

U.S. PATENT DOCUMENTS

| | | | | | |
|---|---|---|---|---|---|
| 3,712,454 | A * | 1/1973 | McKee | 198/782 |
| 6,131,382 | A * | 10/2000 | Dinkelmann et al. | 57/315 |
| 6,131,383 | A * | 10/2000 | Dinkelmann et al. | 57/315 |
| 6,308,878 | B1 * | 10/2001 | Stahlecker | 226/170 |
| 6,318,060 | B1 * | 11/2001 | Dinkelmann et al. | 57/3 |
| 6,324,825 | B2 * | 12/2001 | Dinkelmann et al. | 57/315 |
| 2001/0020357 | A1 * | 9/2001 | Dinkelmann et al. | 57/315 |
| 2001/0037639 | A1 * | 11/2001 | Stahlecker | 57/315 |

FOREIGN PATENT DOCUMENTS

| | | | | |
|---|---|---|---|---|
| CN | 1712588 | | 12/2005 | |
| CN | 101613896 | | 12/2009 | |
| DE | 198 46 268 | | 10/1999 | |
| DE | 100 18 480 | | 10/2001 | |
| DE | 100 50 089 | A1 | 10/2001 | |
| DE | 102 27 463 | | 10/2003 | |
| DE | 10 2005 010 903 | | 9/2005 | |
| DE | 10 2005 044 967 | | 3/2007 | |
| EP | 0 947 614 | | 5/2004 | |
| EP | 1 612 309 | | 9/2009 | |
| JP | 2001081636 | A * | 3/2001 | D01H 5/52 |

* cited by examiner

*Primary Examiner* — Shaun R Hurley
(74) *Attorney, Agent, or Firm* — Dority & Manning, P.A.

(57) ABSTRACT

A device for compacting a sliver (V) on a spinning machine has a driven, revolving compaction element (17) that is acted on by suction air and which has a drive element (28, 29) that, in an operating position, forms a drive connection with a driven element (7, 7*z*) of the spinning machine while forming a first gearing stage (G1). To make the drive of the compaction device more flexible, a second gearing stage (G2) is provided between the drive element (28, 29) of the compaction element (17) of the first gearing stage (G1) and the compaction element (17).

13 Claims, 4 Drawing Sheets

Fig.4
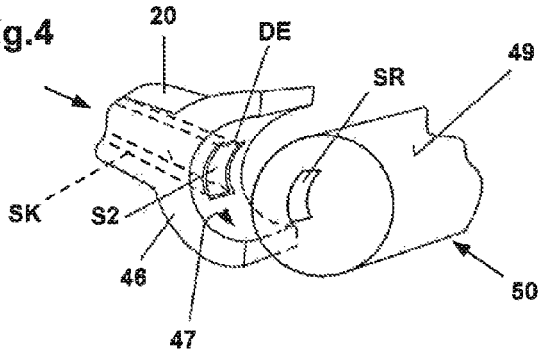
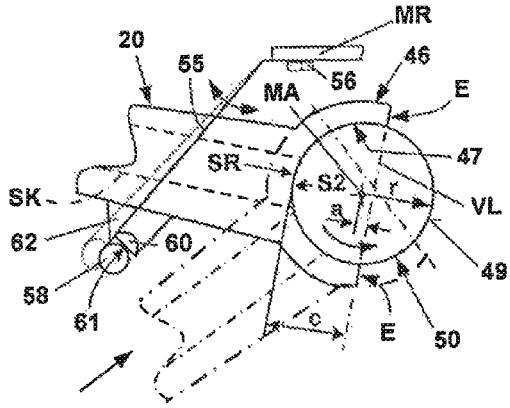
Fig. 5
Fig.2a
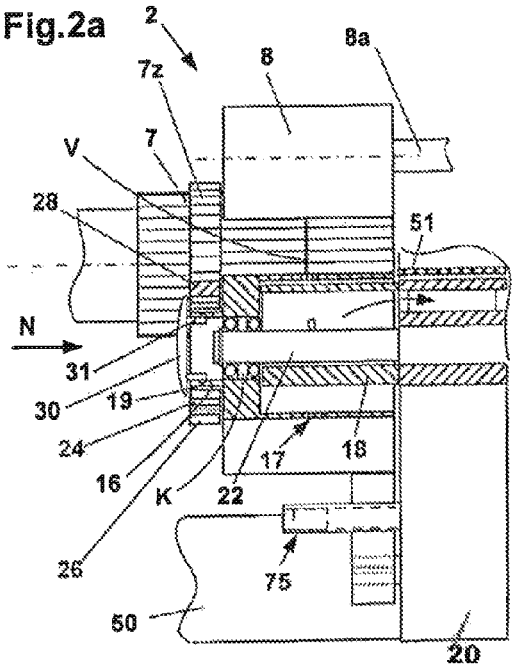
Fig.3a
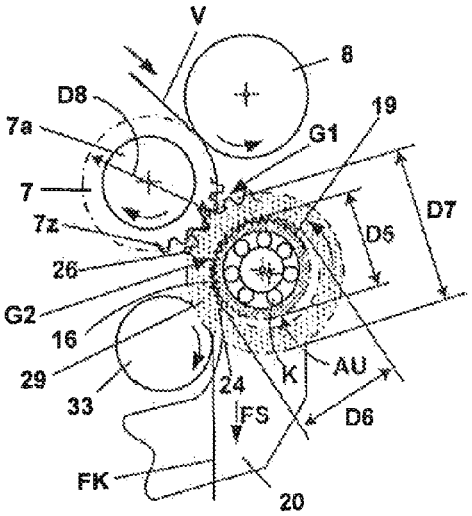

DRIVE DEVICE FOR A COMPACTION DEVICE ON A SPINNING MACHINE

FIELD OF THE INVENTION

The invention relates to a device for compacting a sliver on a spinning machine, having a driven, revolving compaction element that is acted on by suction air and that has a drive element which, in an operating position, forms a drive connection with a driven element of the spinning machine while forming a first gearing stage,

BACKGROUND OF THE INVENTION

Numerous designs are already known in practice, wherein for compacting the fiber material (fiber strand) discharged by a drafting system unit, a compaction unit is situated downstream. Following such a compaction unit, the compacted fiber material, after passing through a nip point, is fed to a twist generation device. Such a twist generation device in a ring spinning machine, for example, is composed of a traveler that revolves on a ring, and the yarn produced is wound onto a rotating bobbin. Suctioned revolving, perforated suction drums or revolving aprons provided with perforations are essentially used as compaction units. A specialized suction area on the compaction element is thus defined by using appropriate inserts inside the suction drum or inside the revolving apron. These types of inserts may be provided, for example, with appropriately shaped suction slits to which a negative pressure is applied, thus generating a corresponding air flow at the periphery of the particular compaction element. In particular, protruding fibers are incorporated as a result of this air flow, which is oriented essentially transversely with respect to the direction of transport.

These types of devices have been illustrated and described in the publications EP 947 614 B1, DE 10 2005 010 903 A1, DE 198 46 268 C2, EP 1 612 309 B1, DE 100 18 480 A1, and CN 1712588 A, for example. These cited publications essentially involve fixedly mounted compaction units which are installed following the particular drafting system. The drive of these compaction units is sometimes achieved via specialized drive shafts that are situated over the length of the spinning machine and that are in drive connection with either a suction roller or a revolving apron. Likewise, the drive of the compaction unit may be achieved via a fixedly mounted drive connection to pressure rollers that rest on the compaction unit and by means of which the drive is transmitted to the compaction unit via friction. Furthermore, examples of drives are found in the exemplary embodiments of the cited publications, wherein the drive of the compaction unit is achieved via additional drive elements of the top and bottom rollers of the pair of delivery rollers of the drafting system unit.

Designs are also known in which conventional drafting systems may be retrofitted with such a compaction device. One such example is found in DE 102 27 463 C1, for example, in which the punch of the drafting system unit is extended in order to support an additional drive roller provided for the drive of the retrofitted compaction device, which is likewise supported on this extension. The drive roller extends over the entire length of the spinning machine.

A design is known from CN 101613896 A in which an additional element is screwed to the punch for extending the punch of the drafting system. Also described in this exemplary embodiment is a gearing stage having gear pairs via which the drive of an additional compaction device is to be achieved. This device is also relatively complicated to install and inflexible regarding the selection of certain gear ratios.

In practice, it is necessary, depending on the fiber material to be processed and the design of the compaction device, to adapt the peripheral speed of the compaction element (revolving suction drum or apron) to the peripheral speed of the pair of delivery rollers of the drafting system in order to obtain the desired compacting of the yarn. This also depends largely on the geometry of the suction slit used inside the compaction element. In many cases it is advantageous for the peripheral speed of the compaction element to be less than the peripheral speed of the delivery rollers of the drafting system in order to obtain compression of the material in the area of the suction slit. In other cases, the converse is advantageous.

A design of a compaction device is known from DE 100 50 089 C2 which is provided for retrofitting of a conventional drafting system unit. A device is proposed that allows the drafting system unit to be retrofitted with a compaction device without additional drive members. Different designs of compaction devices are disclosed in the exemplary embodiments of the cited publication. For its drive, this compaction device lies, for example, with a partial area of its periphery on the driven top roller of the pair of delivery rollers of the drafting system unit. In another disclosed design, deflection rollers connected to the compaction device are in frictional contact with the top roller of the pair of delivery rollers of the drafting system unit in order to accept the drive from the top roller.

A certain gear ratio may be specified by use of this drive device. That is, a gear multiplication or gear reduction may thus be specified. However, if it is necessary to change the gear ratio (for example, when the fiber material is exchanged), this drive device is inflexible and requires a greater expenditure of time to make this change.

SUMMARY OF THE INVENTION

An object of the invention, therefore, is to improve known drive devices and to propose a drive device by means of which the gear ratios may have a variable design and may be changed without a great expenditure of time. A further aim is for the proposed drive device to have a compact design with small space requirements. Objects and advantages of the invention are set forth in part in the following description, or may be obvious from the description, or may be learned through practice of the invention.

In accordance with aspects of the invention, it is proposed that a second gearing stage is provided between the drive element of the compaction element of the first gearing stage and the compaction element.

This results in a compact and flexible drive transmission for the compaction element, with the gear multiplication or gear reduction being flexibly selectable.

It is further proposed that the drive element has a ring-shaped design, the inner surface of which in the operating position rests on a partial area of a circular peripheral surface of a rotatably supported projection that is in drive connection with the compaction element.

Due to the ring-shaped design, it is possible to provide a gearing stage on the outer ring, and a further gearing stage on the inner ring.

The ring-shaped drive element may be provided with toothing on its outer periphery, which in the operating position is engaged with toothing of the driven element of the spinning machine. This allows simple coupling of this gearing stage when the compaction element is transferred from a non-operating stage to an operating stage, for example also for a running machine. In this case, for wear reasons, it is advantageous if at least one of the gearwheels is made of a plastic material or a flexible solid body.

In addition, the ring-shaped drive element may also be provided with toothing on its inner surface that engages with toothing on the peripheral surface of the projection.

Here as well, it is advantageous if at least one of the gearwheels is made of a plastic material or a flexible solid body.

It is preferably further proposed that the ring-shaped drive element is designed as a friction wheel made of an elastic solid body (rubber, for example). That is, the drive element is designed as a ring-shaped disk (made of rubber, for example) that rests with its circular inner surface on the circular outer surface of the projection under the effect of a pressure load. The rotary motion of the disk, which is driven over the outer periphery, is transferred by friction to the outer periphery of the projection, which is connected to the compaction element. This connection may be direct or indirect, depending on whether the compaction element has a suction drum or a perforated apron.

The compaction element may preferably be formed from a rotatably supported suction drum, whereby the projection may be connected to the suction drum in an axially parallel manner. That is, the suction drum and the projection may be made as one piece.

To axially hold the disk-shaped drive element in position on the projection, it is further proposed that the projection at its free end is provided with a receptacle for fastening a closure cap, with the closure cap protruding beyond the outer diameter of the projection in the radial direction. Rapid and simple assembly and disassembly of the ring-shaped drive element is thus possible.

When a ring-shaped friction wheel made of an elastic solid body (rubber, for example) is used, a low-noise, functionally reliable drive stage having two gearing stages is obtained that on the one hand has a low cost, and on the other hand is low-maintenance with regard to soiling by fiber fly.

For use on customary twin drafting systems on ring spinning machines, it is proposed that two suction drums are rotatably supported in an axially parallel manner on a carrier and at a distance from one another, the carrier having a suction channel that is connected to the particular interior of the suction drum.

In this way, two suction drums may be associated with a twin drafting system as a unit (module).

To allow this unit (module) to be easily and exchangeably mounted on a spinning machine, it is further proposed that the carrier is provided with a U-shaped end piece into which one end of the suction channel opens.

By means of this U-shaped end piece it is possible to mount this unit directly on elements of the spinning machine, the outer contour of the elements corresponding to the shape of the U-shaped end piece.

It is preferably further proposed that in addition, two nip rollers are rotatably supported on the carrier, wherein for forming a nip line each of the nip rollers rests on the outer periphery of one of the two suction drums under the action of spring loading.

Thus, a nip roller that is used as a rotational blocking element is also integrated into the module together with the suction rollers, resulting in a complete replacement module of a compaction unit.

It is advantageously further proposed that two suction tubes, which are provided with suction openings for the thread suction, are mounted on the carrier and connected to the suction channel.

For fastening the unit (compaction module) designed with a U-shaped end piece to the carrier, a spinning machine is preferably proposed that is provided with a circular channel for accommodating the carrier, with the channel provided with openings in the area of the fastening of the particular carrier and connected to a negative pressure source.

The device is particularly suited for use on a spinning machine.

Further advantages of the invention are described and shown in greater detail with reference to the following exemplary embodiments.

BRIEF DESCRIPTION OF THE DRAWINGS

The figures show the following:

FIG. 2*a* shows an enlarged partial view X according to FIG. 1 with two adjacently situated drafting system units and compaction devices rotatably supported on a carrier, with a further exemplary embodiment of a drive device according to the invention for the compaction device;

FIG. 3*a* shows a partial view N according to FIG. 2*a* with another example of a drive device according to the invention;

FIG. 4 shows an enlarged perspective partial view, according to FIG. 1, of the fastening point of the carrier;

FIG. 5 shows an enlarged partial view of the carrier according to FIG. 1, with a locking device for the carrier;

DETAILED DESCRIPTION

Figure 1:
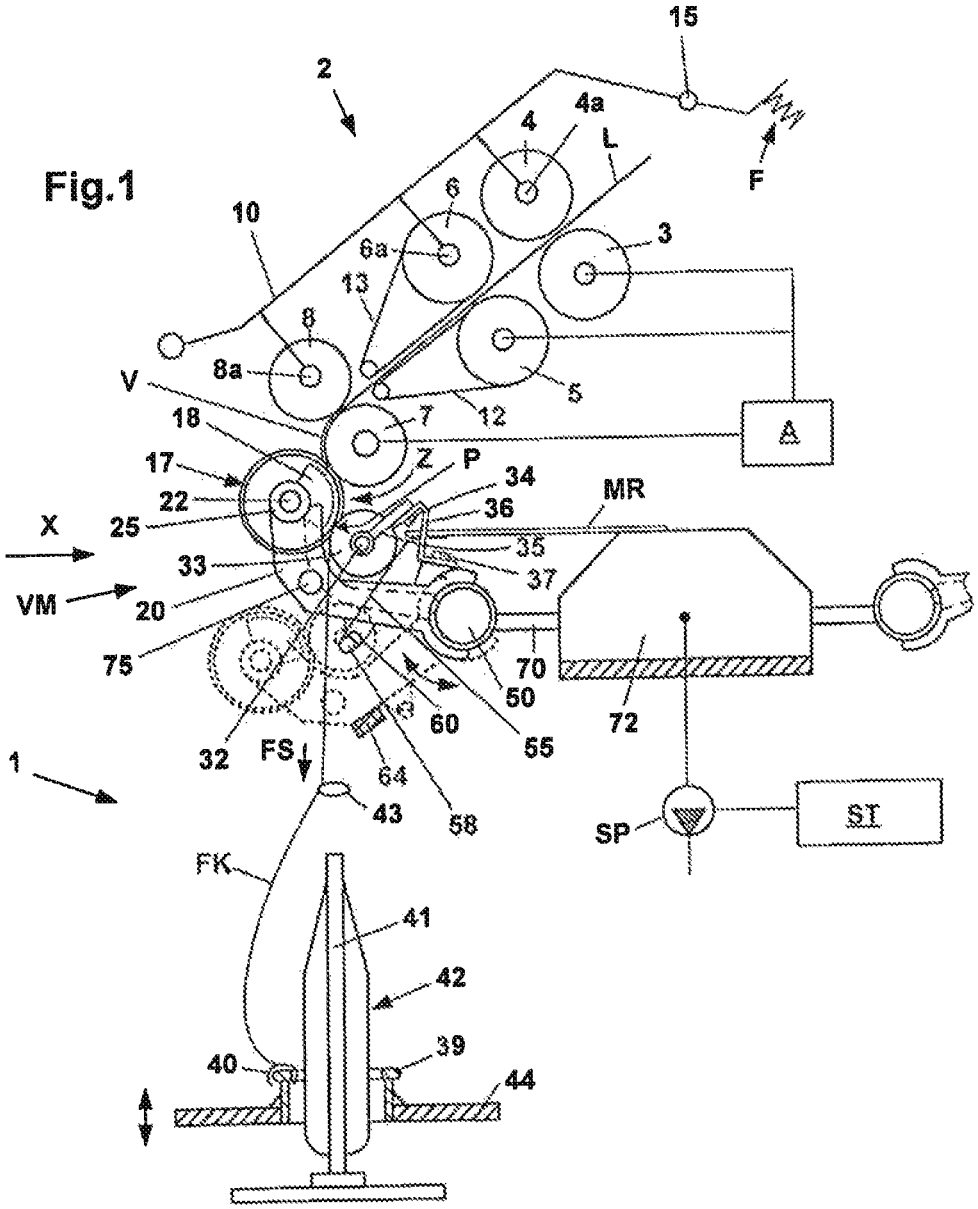
FIG. 1 shows a schematic side view of a spinning station of a ring spinning machine, having a drafting system unit and a subsequent compaction device in the form of a dismountable compaction module.

Reference is now made to particular embodiments of the invention, one or more examples of which are illustrated in the drawings. Each embodiment is provided by way of explanation of the invention, and not as a limitation of the invention. For example, features illustrated as described as part of one embodiment may be used with another embodiment to yield still a further embodiment. It is intended that the present invention include these and other modifications and variations.

FIG. 1 shows a schematic side view of a spinning station 1 of a spinning machine (ring spinning machine), having a drafting system unit 2 that is provided with a pair of feed rollers 3, 4, a pair of middle rollers 5, 6, and a pair of delivery rollers 7, 8. An apron 12, 13 is guided around the middle rollers 5, 6, respectively, each of which is held in its illustrated position around a cage, not shown in greater detail. The upper rollers 4, 6, 8 of the mentioned roller pairs are designed as pressure rollers that are rotatably supported on a pivotably supported pressure arm 10 via the axles 4*a*, 6*a*, 8*a*, respectively, The pressure arm 10 is supported so as to be pivotable about an axle 15, and, as schematically illustrated, is acted on by a spring element F. This spring element may also be an air hose, for example. The rollers 4, 6, 8 are pressed against the bottom rollers 3, 5, and 7, respectively, of the roller pairs via the schematically shown spring loading. The roller pairs 3, 5, 7, as schematically indicated, are connected to a drive A. Individual drives as well as other forms of drives (gearwheels, toothed belts, etc.) may be used. The pressure rollers 4, 6, 8 are driven via the driven bottom rollers 3, 5, 7, respectively, and the apron 13 is driven via the apron 12, by friction. The peripheral speed of the driven roller 5 is slightly greater than the peripheral speed of the driven roller 3, so that the fiber material in the form of a sliver L fed to the drafting system unit 2 is subjected to a break draft between the pair of feed rollers and the pair of middle rollers 5, 6. The main draft of the fiber material L results between the middle roller pair 5, 6 and the pair of delivery rollers 7, 8, the delivery roller 7 having a significantly higher peripheral speed than the middle roller 5.

Figure 2:
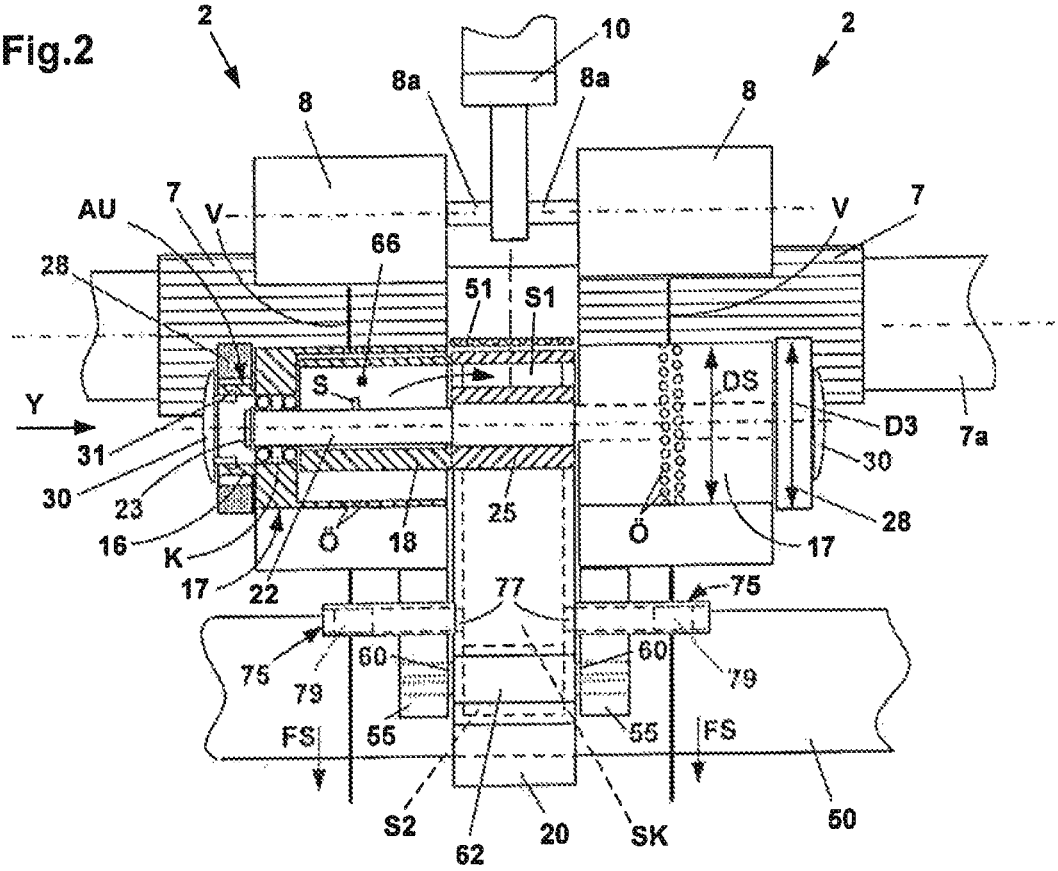
FIG. 2 shows an enlarged partial view X according to FIG. 1 with two adjacently situated drafting system units and compaction devices, rotatably supported on a carrier, with a drive device according to the invention.

As is apparent from FIG. 2 (view X according to FIG. 1), the pressure arm 10 is associated with two adjacent drafting system units 2 (twin drafting system). Since this involves the same or partially mirror-image elements of the adjacent drafting system units, i.e., compaction devices, the same reference numerals are used for these parts.

The drafted fiber material V delivered by the pair of delivery rollers 7, 8 is deflected downwardly and passes into the area of a suction zone Z of a subsequent suction drum 17. The particular suction drum 17 is provided with perforations or openings Ö extending on its periphery. A stationarily supported suction insert 18 is situated in each case inside the rotatably supported suction drum 17. As schematically shown in FIG. 2, the particular suction insert 18 may be held in its installed stationary position by a carrier 20 via holding means, not shown in greater detail. However, an approach would also be possible in which the suction insert 18 is fixedly connected to the carrier. FIG. 2 shows a cover 51, for example, which may have a pivotable design to provide access to the suction drums 17 for cleaning. At the same time, this cover could also be used to fix the suction inserts. A design having dismountable suction inserts, for example, is disclosed in published DE 10 2005 044 967, as well as the design of a suction zone acted on by negative pressure.

As schematically indicated, the particular suction insert 18 has a suction slit S on a partial area of its periphery which extends essentially over the suction zone Z. The particular suction drum 17 is rotatably supported in the area of its outer end on a shaft 22 via bearings K. A retaining ring 23 that prevents displacement of the suction drum during operation is mounted on the shaft 22 for axially fixing the suction drum 17.

The shaft 22 is fastened in a receptacle 25 in the carrier 20. This may be achieved, for example, using fastening means (screws), not shown. In the area of the receptacle 25, the shaft 22 has a slightly larger diameter, while the ends of the shaft 22 extending from this receptacle on both sides have a tapered diameter, and are used for accommodating the particular bearings K. On its end facing away from the carrier 20, the particular suction drum 17 has a ring-shaped projection 16 having an outer diameter D1. A partial area of the inner surface IF of a ring-shaped friction wheel 28 rests on a partial area of the outer periphery of the projection 16, the clearance of this inner surface IF having a diameter D2. In the position shown in FIG. 3 (view Y according to FIG. 2), the particular suction drum 17 is in a working position in which the outer periphery U of the friction wheel 28 rests on the outer periphery U7 of the driven delivery roller 7 via a correspondingly applied pressure load. The closure cap 30 has been omitted in this view to better show the relationships of the gearing stages G1 and G2.

That is, the friction wheel 28 (FIG. 3) is driven in a first gearing stage G1 via friction from the roller 7. Likewise, via friction, the friction wheel 28 transmits the drive in a second gearing stage G2 to the ring-shaped projection 16 of the suction drum 17. This occurs at the location where the inner surface IF having inner diameter D2 of the friction wheel 28, and the outer periphery AU of the projection 16 having outer diameter D1, contact or rest against one another. The friction wheel 28 may be made of an elastic solid material such as rubber.

Figure 3:
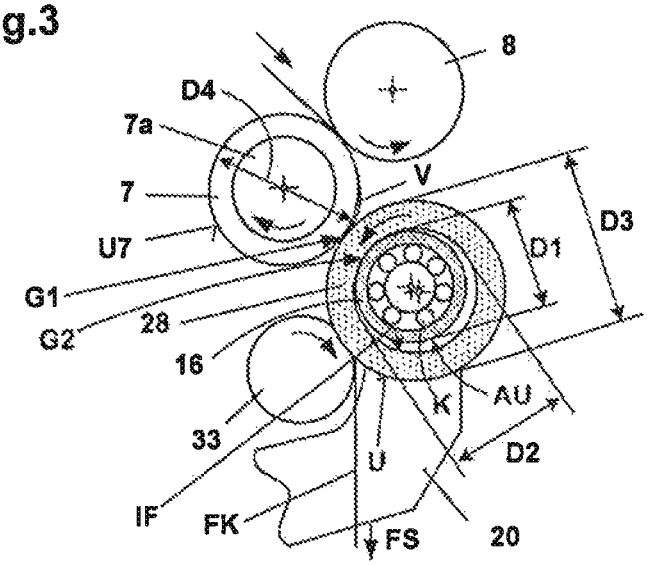
FIG. 3 shows a partial view Y according to FIG. 2 with a drive device according to the invention, having a disk-shaped friction wheel.

In the working position shown in FIG. 3, the outer periphery of the suction drum 17 having diameter DS is situated at a small distance from the outer periphery of the delivery roller 7. This is ensured when the following dimensional relationships are present:

$$\frac{DS}{2} < \frac{D1}{2} + \left(\frac{D3}{2} - \frac{D2}{2}\right).$$

The particular peripheral speed, i.e., the rotational speed, of the suction drum 17 results from the selected diameter ratios D1 through D4. That is, the gear ratio between the driven delivery roller 7 and the particular suction drum 17 results from the relationship $$\frac{D4}{D3} \times \frac{D2}{D1}.$$

Depending on the selection of the diameter ratios, it is thus possible to select the peripheral speed of the particular suction drum 17 to be greater or smaller than the peripheral speed of the driven delivery roller 7. In some cases, it is advantageous to select the gear ratio in such a way that the peripheral speed of the subsequent suction drum 17 is slightly less than the peripheral speed of the delivery roller 7. It is thus possible, for example, to compensate for lateral displacement of the fiber material in the area of the suction zone Z above a correspondingly designed suction slit S. The suction zone Z, viewed in the peripheral direction of the suction roller 17, extends approximately between the area where the friction wheel rests on the delivery roller 7 and the nip line P between a nip roller 33 and the suction drum 17.

FIG. 2*a* shows another view X according to FIG. 1, except that in contrast to FIG. 2, only one-half of the twin drafting system is shown. Up to the area of the drive elements for the compaction elements (suction drums 17 or revolving apron, not shown), the design according to FIG. 2*a* corresponds to that in FIG. 2. In the exemplary embodiment according to FIG. 2*a*, which is shown in the view N in a side view in FIG. 3*a*, the ring-shaped drive element is designed as a gearwheel 29 that is provided with external toothing 26. In the operating position, the toothing 26 in a first gearing stage G1 is engaged with toothing 7*z* which is provided on the delivery roller 7. The gearwheel 29 also has internal toothing 24, which in the operating position shown in FIG. 3*a* in a second gearing stage G2, is engaged with toothing 19 provided on the outer periphery AU of the projection 16. Similarly as for the described use of a friction wheel 28, the gear ratio results from the partial circle diameter of the toothings of these two gearing stages G1, G2, as follows:

$$\frac{D8}{D7} \times \frac{D6}{D5}.$$

In this embodiment variant as well, the gear ratio may be adjusted, depending on the selection of the partial circle diameters.

An embodiment variant (not shown) is also possible in which the ring-shaped drive element is provided with toothing 26 on its outer periphery, as shown in FIG. 3*a*, which is engaged with toothing 7*z* of the delivery roller 7, the drive element having a clearance with an inner surface IF that rests on the flat outer surface AU of the projection 16, as shown in the example in FIG. 3. That is, in this design the first gearing stage G1 has a positive-fit drive connection, while the second gearing stage G2 is achieved via a frictional lock. Of course, the converse variant is also possible in which the drive element has a frictional lock connection over its outer periphery, and in the area of its clearance is in drive connection with the projection 16 via toothing.

As is apparent from FIG. 2, a closure cap 30 is fastened in the area of the ring-shaped projection 16, which with its outer diameter protrudes beyond the clearance D2 of the friction wheel 28. The closure cap 30 is provided with a ring-shaped projection 31 that protrudes into the clearance of the ring-shaped projection 16 of the suction drum 17. The outer dimensions of the ring-shaped projection 31 are selected in such a way that in the position shown in FIG. 2, they exert a clamping effect within the clearance of the projection 16. As schematically illustrated, the ring-shaped projection 31 may be provided with additional outwardly protruding cams, which for fixing the closure cap 31 engage in circumferential indentations within the clearance of the projection 16. Numerous designs are possible for fixing the closure cap 30 in the position shown in FIG. 2. As a result of the closure cap 30, the friction wheel 28 is held in position on the shaft 22 in the axial direction.

As is apparent from FIG. 2, two suction drums 17 of adjacent spinning stations are rotatably supported on the shaft 22 fastened to the carrier 20. The suction drums 17 together with a respective friction wheel 28 (or gearwheel 29 corresponding to FIG. 2*a*) are situated in a mirror image with respect to the carrier 20.

Following the suction zone Z, for each of the suction drums 17, a nip roller 33 is provided that rests on the respective suction drum 17 via a pressure load and, with this suction drum, forms a nip line P. The particular nip roller 33 is rotatably supported on an axle 32 that is fastened to a bearing element 35 connected to a spring element 36 via screws 34 (or some other fastening elements). The spring element 36, via which a contact force of the nip roller 33 is generated in the direction of the suction drum 17, is fastened to the carrier 20 via the schematically illustrated screws 37 (or some other fastening elements). This fastening point may be designed in such a way (for example, by means of oblong holes in the spring element 36) that the contact force of the nip roller 33 on the suction drum 17 is settable.

At the same time, the nip line P forms a so-called "twist-stop" from which the fiber material is fed, in the conveying direction FS in the form of a compressed yarn FK with imparting of twist, to a schematically shown ring spinning device. The ring spinning device is provided with a ring 39 and a traveler 40, the yarn being wound onto a bobbin 41 to form a spool 42 (cop). A thread guide 43 is situated between the nip line P and the traveler 40. The ring 39 is fastened to a ring frame 44 that undergoes an up-and-down motion during the spinning process.

On its end opposite from the spinning machine, the carrier 20 is provided with a U-shaped or fork-shaped end piece 46, which in the mounted position shown in FIG. 1 and FIG. 5, rests with its inner surface 47 on a partial area of the outer periphery 49 of a suction tube 50. As is apparent in particular from FIG. 5, the fork-shaped end piece 46 is designed in such a way that the connecting line VL between the ends E of the end piece extends at a distance "a" from the center axis MA of the suction tube 50. That is, in the installed position of the carrier 20 shown in FIG. 1 and FIG. 5, the distance "c" between the connecting line VL and a plane parallel thereto that is tangential with respect to the inner surface 47 is greater than the radius "r" of the suction tube 50 by the dimension "a". It is thus ensured that a clamping effect results between the inner surface 47 of the end piece 46 and the outer periphery 49 of the suction tube 50, and the carrier is held in this installed position. For the installation in this position, the carrier 20 is pushed onto the suction tube 50 in the position shown by a dashed line by means of a small pressure force shown in the direction of the arrow. The material of the carrier 20, at least the material of the end piece 46, is selected in such a way, that in the attachment operation on the suction tube 50, the legs of the end piece 46 may elastically yield, whereby after the attachment operation the inner surface 47 of the end piece 46 rests completely on the outer periphery 49 of the suction tube 50. The contact pressure effect between the end piece 46 and the suction tube 50 is selected in such a way that it is possible for the carrier 20 to pivot about the center axis MA of the suction tube 50. To hold the carrier 20 and the suction drums 17 rotatably supported thereon together with the nip rollers 33 in a working position in which the respective friction wheels 28 are in drive connection with the delivery rollers 7 via a contact pressure force, a spring rod 55 is provided on each side of the carrier and is fastened to the machine frame MR of the spinning machine via fastening elements 56 (screws, for example). A circular rod 58 is fastened to the free end of the particular spring rod 55. As is apparent in particular from FIG. 5, in this position a flat surface 61 of a semicircular rod 60 rests on the periphery of the circular rod 58. The rod 60 is fixedly connected to the carrier 20 via a web 62. As schematically shown in FIG. 2, the semicircular rod 60 extends on each side of the carrier 20, and in the working position rests on the rod 58 and assumes a locking position. This locking position may be released only by applying an appropriate force. This is the case when the compaction module VM must be swiveled into a lower position shown by dashed lines (FIG. 1). This swiveling is necessary when access to the drafting system output must be gained for maintenance operations, or when the compaction module itself must be serviced. To hold the compaction module VM in the lower position shown by dashed lines, a stop 64 is provided which is mounted on the machine frame. In this position, the compaction module may also be removed by manually pulling the suction tube 50 from the spinning machine. In the described swiveling operation of the compaction module VM into a lower position, the particular spring rod 55 yields in the position indicated by dotted lines, so that the rod 60 may slide past the rod 58. As soon as the rod 60 has passed the rod 58, the spring rod 55 resumes its original position due to the spring effect. In the upward swiveling of the carrier 20 about the center axis MA, the semicircular surface of the rod 60 meets the peripheral surface of the rod 58, and upon further swiveling pushes the rod 58 into the position indicated by dotted lines. As soon as the flat surface 61 of the rod 60 is located above the rod 58, the rod is moved back into the original position due to the elastic force of the spring rod 55 and resumes its locked position with the rod 60, as shown in FIG. 5.

Extending within the carrier 20 is a suction channel SK that has an opening S2 on the inner surface 47 of the end piece 46, and which has a further opening S1, situated in the area of the receptacle 25, which is connected to the interior 66 of the particular suction insert 18. In the working position, the opening S2 is situated opposite from an opening SR in the suction tube 50, as the result of which the interior of the suction tube 50 is connected to the suction channel SK. To seal off the connection between the opening S2 and the opening SR from the outside, a sealing element DE is provided in the area of the inner surface 47 of the end piece 46 that is placed around the opening S2. The sealing element DE is designed or mounted in such a way that it comes into contact with the outer periphery of the tube 50 during installation of the carrier 20, and seals the connecting point between the openings S2 and SR with respect to the surroundings.

As is apparent from FIG. 1, the suction tube 50 is connected to a central main channel 72 via one or more connecting channels 70. This channel 72 is connected to a negative pressure source SP that may be controlled via a control unit ST. Further connections (not shown) to the suction channel 72 may also be provided, which are connected to appropriate suction stations for keeping the spinning machine clean.

In the event of a thread break between the nip line P and the spool 42, to be able to suction yarn FK that is further delivered via the nip point P, a suction tube 75 is fastened to each side of the carrier 20, whose respective opening 77 facing the carrier 20 is connected to the channel SK. The outwardly protruding end, viewed from the carrier, of the particular suction tube 75 is closed. An opening 79 that points in the direction of the downwardly pulled yarn FK is provided on a partial area of the periphery of the particular suction tube. That is, if a thread break occurs, via the suction channel SK, the end of the further delivered thread or yarn is fed to the suction tube 50 via the particular suction tube 75 under the action of the negative pressure generated via the negative pressure source SP, and the suction tube delivers the thread or yarn via the channel(s) 70 to the main channel 72 for further supply to a collection station.

As a result of the proposed design of a compaction module, it is possible to integrate or add this type of compaction unit, also as a retrofit to conventional spinning machines, without having to install additional specialized drive means (for example, additional driven longitudinal shafts). The drive of the suction drum, as well as the drive of the nip roller cooperating with the suction drum, is easily removed from the driven delivery roller, already present, of the drafting system unit 2 via the friction wheel gearing that is integrated on the compaction module or the shown drive via a gearwheel provided with additional internal toothing. That is, no additional longitudinal shafts must be mounted on the spinning machine in order to integrate a device for compacting the sliver on the spinning machine. Each compaction module VM is a separate closed unit, and in the proposed version is provided for two adjacent spinning stations in each case.

Figure 6:
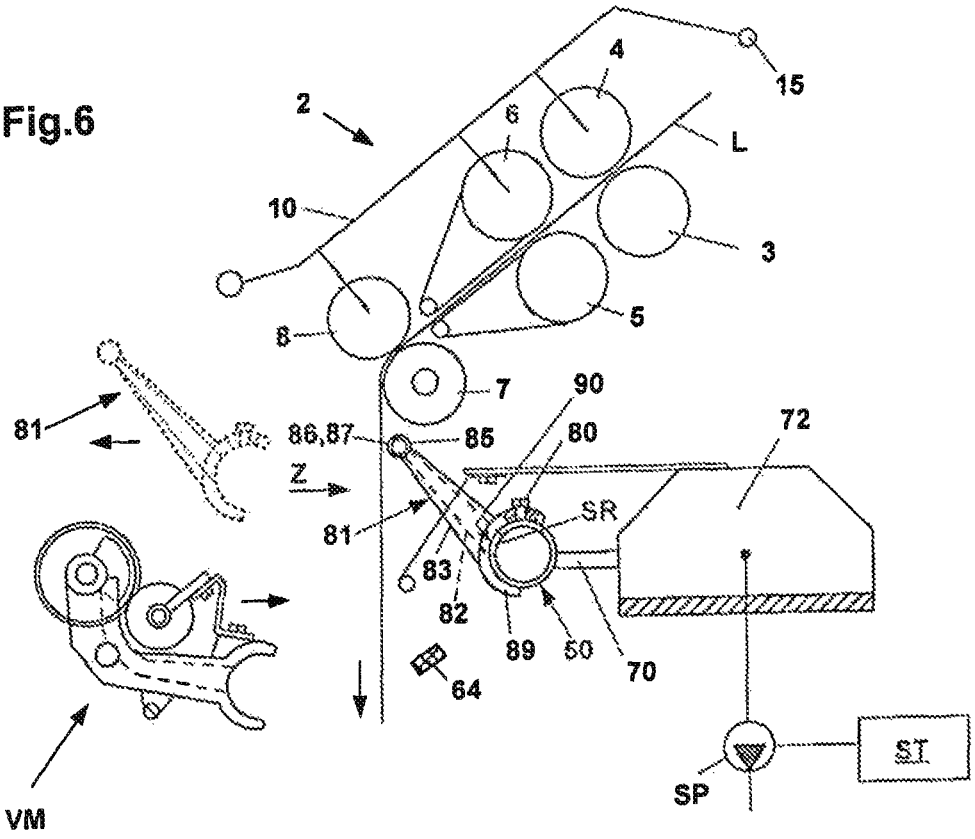
FIG. 6 shows a schematic partial view according to FIG. 1, without a compaction device.
Figure 7:
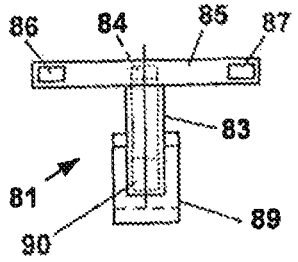
FIG. 7 shows a view Z of the thread suction tube according to FIG. 6.

As is apparent from the schematic illustration in FIG. 6, a thread suction tube 81 on a conventional spinning machine (without a compaction unit) may be fastened to the suction tube 50 via fastening means 80 (screws, for example) and exchanged with a compaction module VM. The channel 82 inside the suction tube 81 likewise opens into the opening SR in the suction tube 50. As is apparent, for example, from the view Z (according to FIG. 6) in FIG. 7, the thread suction tube 81 is provided with a transverse tube 85 connected to a central tube piece 83. To be able to carry out the thread suction at two adjacent spinning stations, openings 86, 87 that point in the direction of the yarn, which in each case is pulled downwardly, are provided in each case in the area of the two ends of the transverse tube 85. A U-shaped end piece 89 is fastened to the end of the tube piece 83, and essentially corresponds to the end piece 46 mounted on the compaction module VM. The opening 90 in the tube piece 83, which ends in the area of the end piece 89, in the installed position is opposite from the opening SR in the suction tube 50. For sealing off this connecting point, sealing elements may also be provided as described for the compaction module. The other opening 84 is connected to the interior of the transverse tube 85. These two units may thus be easily and quickly exchanged with one another. That is, conversion or retrofitting of this type of spinning machine to a design having a compaction unit is possible within a relatively short time period. This ensures universal use of a spinning machine by the spinning mill owner.

Thus, using appropriate color coding of the spools, on a single spinning machine it is possible to equip partial regions with compaction devices, while at the other regions, yarns are produced without compacting. That is, by use of this device, a spinning machine may be used in an even more universal manner.

Modifications and variations can be made to the embodiments illustrated or described herein without departing from the scope and spirit of the invention as set forth in the appended claims.

The invention claimed is:

1. A compaction device for compacting a sliver on a spinning machine, comprising:

a revolving compaction element actuated by suction air, the compaction element further comprising a drive element that, in an operating position of the compaction device in the spinning machine, forms a drive connection with a driven element of the spinning machine;

a first gearing stage defined between the drive element and the driven element of the spinning machine in the installed position of the compaction device on the spinning machine;

the compaction element driven by a rotatably supported projection;

a second gearing stage between the drive element and the rotatably supported projection; and wherein the drive element has a ring-shaped configuration with an inner diameter surface that rests on a partial area of a circular peripheral surface of the rotatably supported projection to define the second gearing stage.

2. The compaction device as in claim 1, wherein the ring-shaped drive element comprises a toothed surface on an outer diameter surface thereof that engages with drive teeth on the driven element of spinning machine in the installed position of the compaction device on the spinning machine.

3. The compaction device as in claim 2, wherein the ring-shaped drive element comprises a toothed surface on the inner diameter surface that engages with teeth on the surface of the rotatably supported projection.

4. The compaction device as in claim 1, wherein the ring-shaped drive element comprises a friction wheel.

5. The compaction device as in claim 1, wherein the compaction element comprises a first rotatably supported suction drum.

6. The compaction device as in claim 5, wherein the first rotatably supported projection is axially aligned and connected to the suction drum.

7. The compaction device as in claim 6, further comprising a closure cap fitted on a free end of the rotatably supported projection, the closure cap extending radially outward of an outer diameter of the rotatably supported projection.

8. The compaction device as in claim 5, further comprising a second rotatably supported suction drum, wherein the first and second suction drums are axially aligned and rotatably supported on a common carrier, the common carrier having a suction channel connected to an interior of each suction drum.

9. The compaction device as in claim 8, wherein the common carrier comprises a U-shaped end piece, the suction channel opening into the U-shaped end piece.

10. The compaction device as in claim 8, further comprising two nip rollers rotatably supported on the common carrier, each nip roller spring loaded against an outer periphery of a respective one of the suction drums to form a nip line.

11. The compaction device as in claim 8, further comprising two suction tubes mounted on the common carrier and connected to the suction channel, each suction tube having a suction opening for a thread suction process.

12. The compaction device as in claim 8, wherein the common carrier is configured to connect to an opening in a negative pressure channel provided on the spinning machine.

13. A spinning machine for processing a sliver, comprising:

a drafting system having a pair of delivery rollers;

a device for compacting the sliver delivered by the delivery rollers, the compacting device further comprising:

a revolving compaction element actuated by suction air, the compaction element further comprising a drive element in a drive connection with a bottom roller of the delivery rollers;

a first gearing stage defined between the drive element and the bottom roller of the delivery rollers;

the compaction element driven by a rotatably supported projection;

a second gearing stage between the drive element and the rotatably supported projection; and wherein the drive element has a ring-shaped configuration with an inner diameter surface that rests on a partial area of a circular peripheral surface of the rotatably supported projection to define the second gearing stage.

* * * * *